US005322366A

United States Patent [19]

Revlett et al.

[11] Patent Number: 5,322,366

[45] Date of Patent: Jun. 21, 1994

[54] INTERIOR DOOR SHELF SUPPORT SYSTEM FOR REFRIGERATOR

[75] Inventors: John R. Revlett, Henderson County; Donna J. Heacock, Henderson, both of Ky.; Patrick A. Braun, Ohio Township, Warrick County, Ind.; Jeffrey A. DeBoer, Ann Arbor, Mich.

[73] Assignee: Whirlpool Corporation, Benton Harbor, Mich.

[21] Appl. No.: 13,523

[22] Filed: Feb. 4, 1993

[51] Int. Cl.[5] ..... E05B 65/46

[52] U.S. Cl. ..... 312/405.1; 312/321.5; 248/221.3

[58] Field of Search ..... 312/408, 408.1, 405.1, 312/214, 321, 321.5; 108/110; 211/90, 187, 153; 248/221.3, 221.4

[56] References Cited

U.S. PATENT DOCUMENTS 3,156,509 11/1964 Padgett .
3,214,230 10/1965 Vaughn .
3,227,502 1/1966 Roberts .
3,402,907 9/1968 Fisher .
3,480,243 11/1969 Summorville ..... 248/221.4
3,598,064 8/1971 Stempel .
3,709,576 1/1973 Lemoine .
4,815,685 3/1989 Roberts et al. .
4,859,010 8/1989 Jeziorowski .
4,908,544 3/1990 Lau .
5,042,398 8/1991 Lau ..... 108/110
5,160,191 11/1992 Holland ..... 312/405.1
5,226,717 7/1993 Hoffman ..... 312/405.1

*Primary Examiner*—Kenneth J. Dorner
*Assistant Examiner*—Gerald A. Anderson
*Attorney, Agent, or Firm*—Thomas J. Roth; Stephen D. Krefman; Thomas E. Turcotte

[57] ABSTRACT

A refrigerator door includes an inner door panel having parallel, vertical dikes and horizontal shelves extending between the dikes. A door shelf support system includes a shelf trim piece mountable on the inner door panel. The trim piece includes end walls having openings receiving projections extending sidewardly from the dikes to provide a snap-fit connection without openings extending through the dikes. The trim piece can be a one-piece structure having a channel at a bottom edge for receiving a front edge of the shelf to provide a closed shelf arrangement, or can have a shorter front wall to provide an open shelf arrangement with the trim piece wall spaced above the door shelf.

19 Claims, 3 Drawing Sheets

Fig. 1
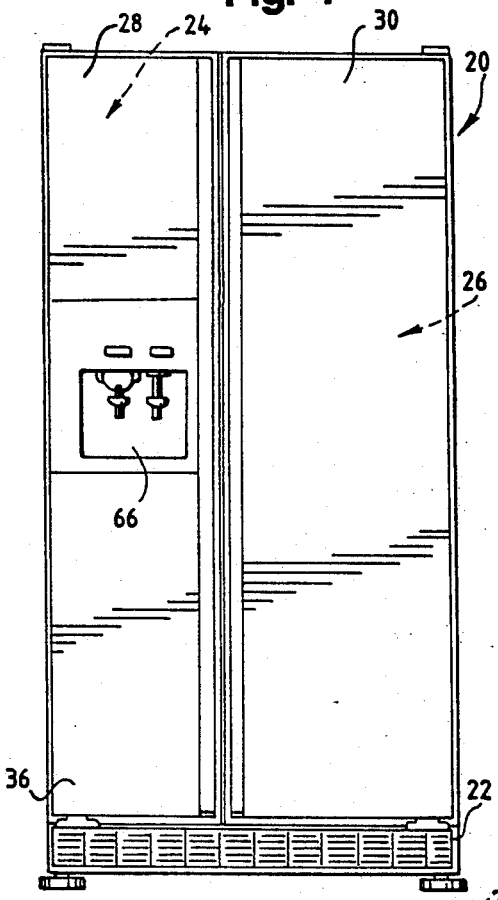
Fig. 2
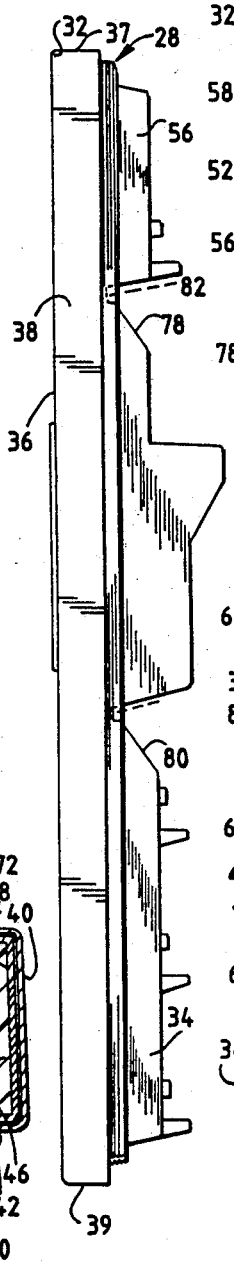
Fig. 3
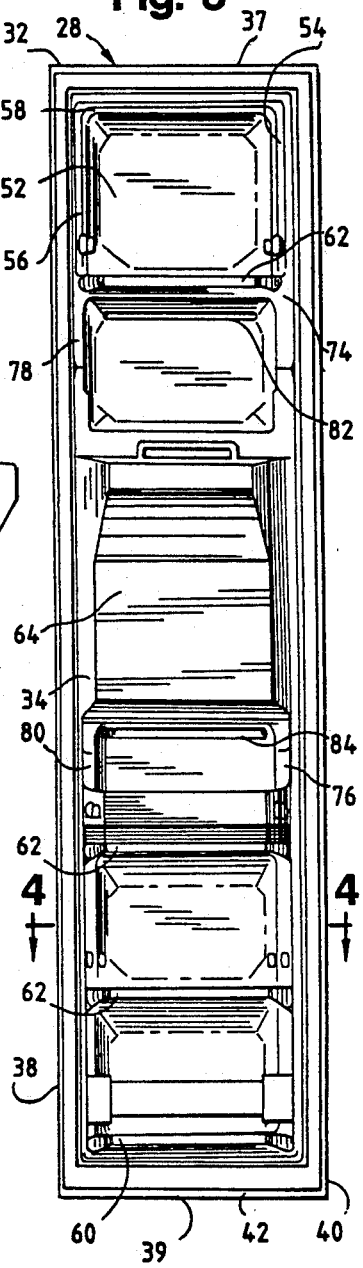
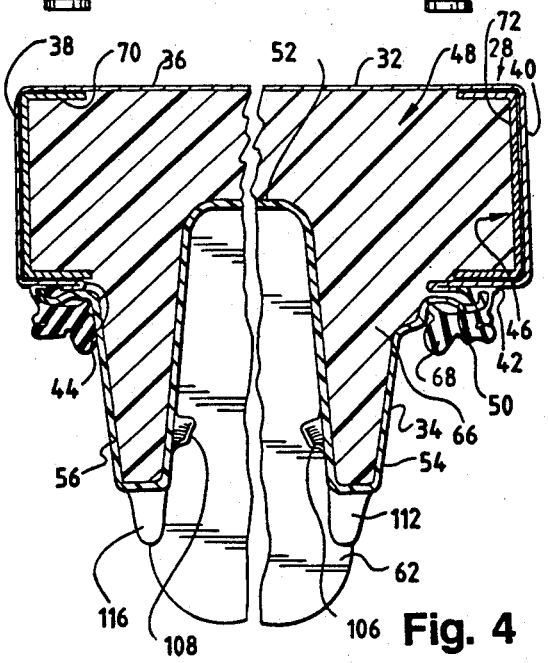
Fig. 4

Fig. 5
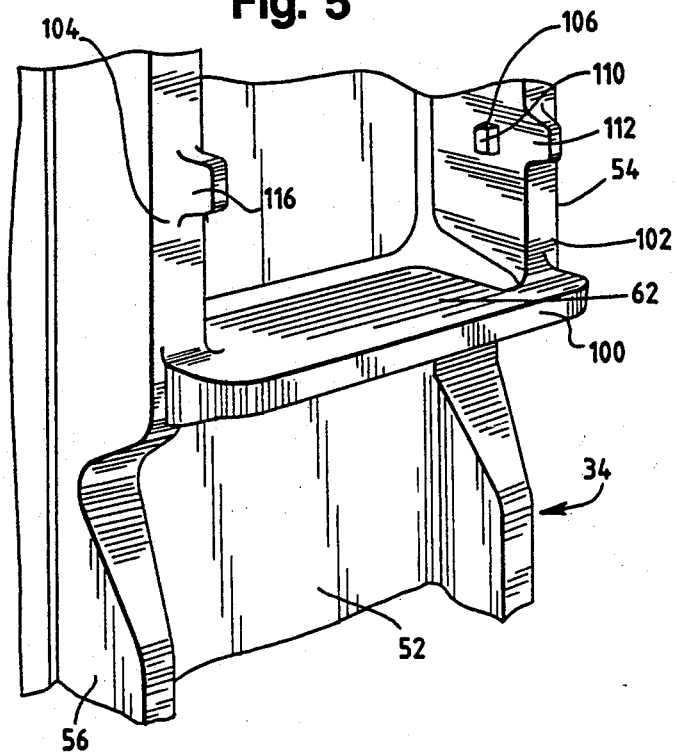
Fig. 6
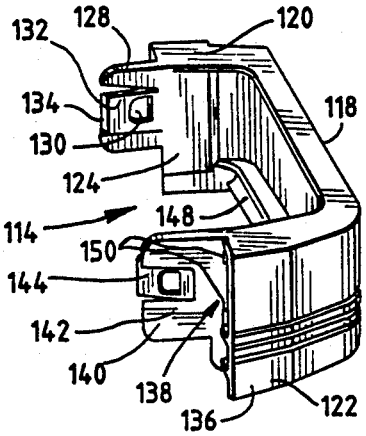
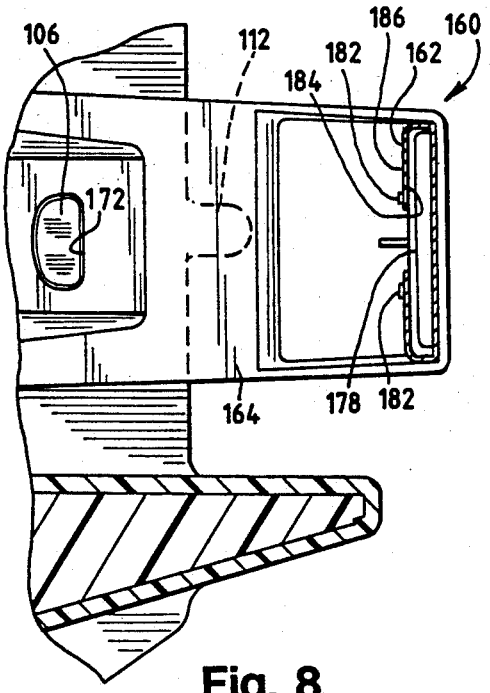
Fig. 8
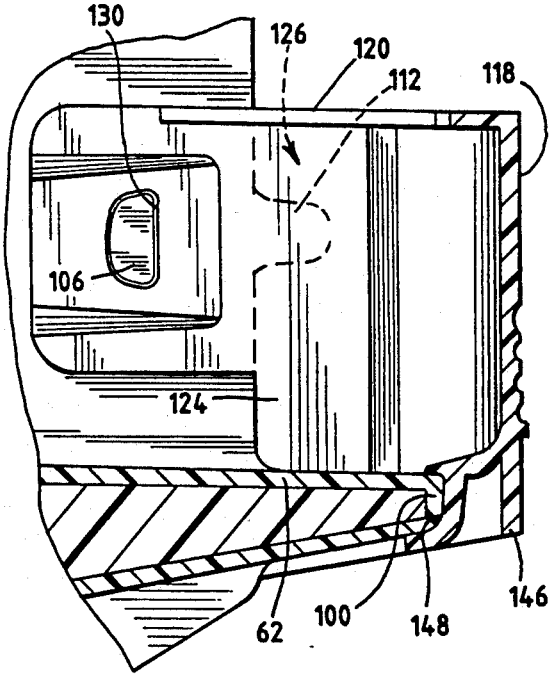
Fig. 7

Fig. 9
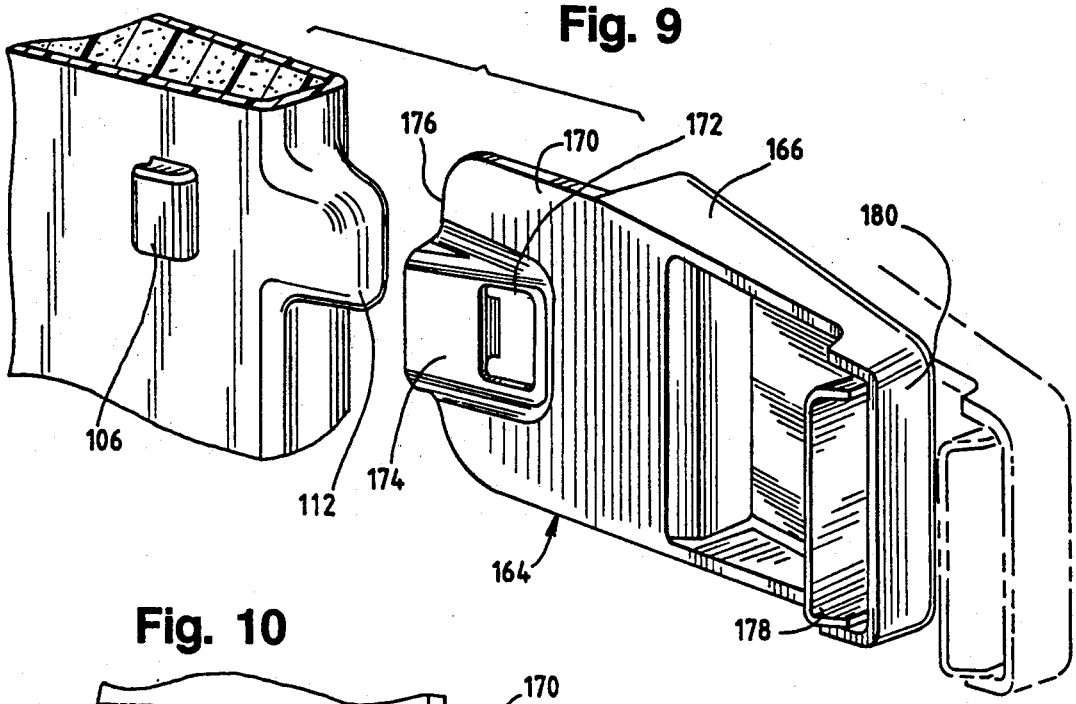
Fig. 10
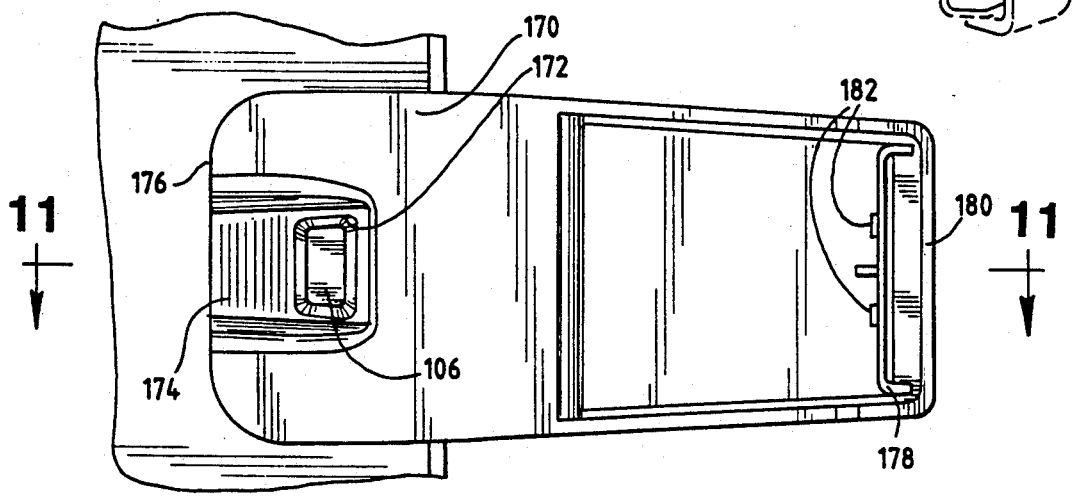
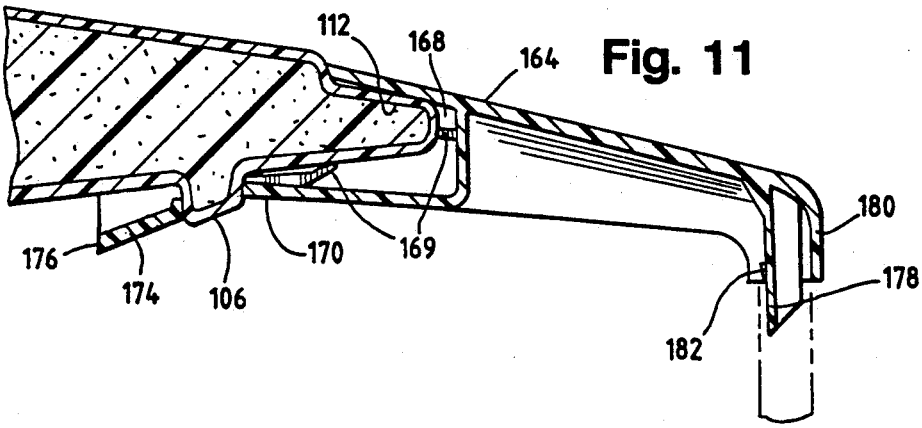
Fig. 11

INTERIOR DOOR SHELF SUPPORT SYSTEM FOR REFRIGERATOR

FIELD OF THE INVENTION

This invention relates generally to a refrigeration apparatus and, more particularly, to a door shelf support system.

BACKGROUND OF THE INVENTION

A refrigeration apparatus typically includes a cabinet having an internal storage space accessible through an access opening. A door is hingedly mounted to the cabinet for selectively closing the access opening. Known refrigeration apparatus include various systems for mounting shelves or storage bins on the doors. One storage system, shown in Lau, U.S. Pat. No. 4,908,544, uses a storage bin mounting system including a pin and hook arrangement for mounting storage bins to vertical dikes in the door.

Another storage system includes horizontal shelves formed in the inner door panel. A trim piece having end caps is snap fit into openings in the vertical dikes. The trim piece usually is one of two types. One type comprises a pair of end caps which snap fit into the openings and which capture an elongate front piece. The horizontal shelf extends frontwardly beyond the dikes to beneath the front piece. This provides an open shelf arrangement which is open between the shelf and the front piece. An alternative design uses a single piece molded trim piece having a bottom wall. The horizontal shelf is flush with the dikes. The bottom wall matches up with the door panel formed shelf to provide a shelf extension. To satisfy all potential purchasers, it is desirable for a manufacturer to provide refrigerator lines using both types of trim pieces. To do so, one must stock inner door panels having different structures to accommodate the different trim pieces.

Additional problems have been found relative to trim pieces which are snap fit into openings in the inner door panel. For example, owing to the various structure used for mounting the same, there is a perception that the end caps are not removable. Also, a side impact on the end cap could cause breakage of the trim piece while the existence of a hole in the dike can spur cracks in the inner door panel. Finally, when a refrigerator door is filled with polyurethane foam during an insulation process for a foamed-in-place door, the foam would leak out of any holes in the inner door panel. This would require steps being taken to prevent the foam from leaking out the holes.

The present invention is intended to overcome one or more of the problems set forth above, in a novel and simple manner.

SUMMARY OF THE INVENTION

In accordance with the invention, a door shelf support system is provided in which trim pieces are readily removable and less subject to breakage. Moreover, a uniform inner door panel design is used for different types of trim pieces. Finally, the door shelf support system can be used in connection with a foamed-in-place door.

Broadly, there is disclosed herein a door shelf support system in a refrigeration apparatus cabinet defining a storage space and having a door providing selective access to the space. The system comprises an inner door panel including parallel, vertical dikes, each dike including a plurality of vertically spaced, sidewardly extending projections. A shelf trim piece is mountable on the panel and comprises a front wall connected to opposite end walls. The end walls are spaced apart a select distance slightly less than the distance between the dikes to be received therebetween. Each end wall includes an aperture. At least one of the dikes and the end walls is temporarily deformed when the trim piece end walls are inserted between the dikes, with opposite ones of the projections engaging the end walls until the projections are received in the apertures to provide a snap fit connection to retain the trim piece on the door panel.

It is a feature of the invention that the inner door panel comprises a unitary molded plastic panel.

It is another feature of the invention that the shelf trim piece comprises a molded plastic trim piece.

It is another feature of the invention that the trim piece comprises a pair of end caps, each defining one of the end walls, and an elongate front piece captured by and extending between the end caps.

There is disclosed in accordance with another aspect of the invention a door shelf support system comprising an inner door panel including parallel, vertical dikes, a horizontal shelf extending between the dikes, and a projection extending sidewardly from each dike and spaced a select distance above the shelf. A shelf trim piece is mountable on the inner door panel and comprises a front wall connected to opposite end walls. The end walls are spaced apart a select distance slightly less than the distance between the dikes, to be received therebetween. Each end wall includes an aperture. At least one of the dikes and the end walls is temporarily deformed when the trim piece end walls are inserted between the dikes, with opposite ones of the projections engaging the end walls, until the projections are received in the apertures to provide a snap fit connection to retain the trim piece on a door panel above the shelf.

It is a feature of the invention that the shelf trim piece includes a front wall extending between the end walls, and the lower edge of the front wall includes a channel receiving a front edge of the shelf to provide a generally closed shelf arrangement.

It is another feature of the invention that the shelf front edge is disposed frontwardly of a front edge of the dikes.

There is disclosed in accordance with another aspect of the invention a door shelf support system comprising an inner door panel including parallel, vertical dikes, a horizontal shelf extending between the dikes, a first projection extending sidewardly from each dike and spaced a first select distance above the shelf and a second projection extending frontwardly from each dike and spaced a second select distance above the shelf. A shelf trim piece is mountable on the inner door panel and comprises a front wall connected to opposite end caps. Each end cap includes a base defining a rearwardly opening channel and connected to a rearwardly extending end wall. The end walls are spaced apart a select distance slightly less than a distance between the dikes to be received therebetween. Each end wall includes an aperture. At least one of the dikes and the end walls are temporarily deformed when the trim piece end walls are inserted between the dikes, with opposite ones of the projections engaging the end wall until the first projections are received in the apertures and the second projections are received in the channels to provide a stable, snap fit connection to retain the trim piece on the door panel above the shelf.

It is a feature of the invention that each end wall includes a raised ramp portion extending from the opening to a distal edge to facilitate insertion of the end walls between the dikes.

It is another feature of the invention that the first projections include a ramped distal surface to facilitate insertion of the end walls between the dikes.

It is another feature of the invention that the first and second selected distances are identical.

Further features and advantages of the invention will be readily apparent from the specification and from the drawing.

BRIEF DESCRIPTION OF THE DRAWING

FIG. 1 is a front elevation view of a refrigerator including a door shelf support system embodying the invention;

FIG. 2 is a side elevation view of a freezer door of the refrigerator of FIG. 1;

FIG. 3 is an inside elevation view of the door of FIG. 2;

FIG. 4 is a partial sectional view taken along the line 4—4 of FIG. 3; .

FIG. 5 is a partial, exploded perspective view illustrating an inner door panel for the door shelf support system according invention;

FIG. 6 is a perspective view of a trim piece for the door shelf support system according to one embodiment of the invention;

FIG. 7 is a sectional view showing the door shelf support system one embodiment of the invention;

FIG. 8 is a sectional view similar to that of FIG. 7 showing a door shelf support system according to an alternative embodiment of the invention;

FIG. 9 is an exploded view illustrating a portion of the door shelf support system of FIG. 8;

FIG. 10 is a partial, elevation view of the door shelf support system of FIG. 8; and FIG. 11 is a sectional view taken along the line 11—11 of FIG. 10.

DETAILED DESCRIPTION OF THE INVENTION

Referring to FIG. 1, a refrigeration apparatus, such as a refrigerator/freezer 20, includes a cabinet having an improved door shelf support system.

The refrigerator/freezer 20 includes a cabinet 22 provided with an internal liner and an insulating separator or divider wall (not shown) to define a below-freezing, or freezer, compartment 24 and a fresh food, or above-freezing, compartment 26. Each of the compartments 24 and 26 comprises a refrigerated storage space, as is well known.

The freezer compartment 24 is accessible through an access opening (not shown). A freezer door 28 selectively closes the freezer compartment access opening. Similarly, the fresh food compartment 26 includes an access opening (not shown). A fresh food door 30 selectively closes the fresh food compartment access opening.

With reference to FIGS. 2–4, the freezer door 28 includes an outer door panel or shell 32 and an inner door panel or liner 34. The outer shell 32 is typically formed of metal in the configuration of a parallelepiped having an outer rectangular panel 36 connected to four inwardly turned side panels 37–40. Each of the side panels 37–40 is connected to a return inwardly facing peripheral flange 42 surrounding a rectangular opening 44. The outer panel 36, together with each of the side panels 37–40 and flange 42, defines a generally C-shaped channel 46 surrounding an inner space 48. The space is accessible through the opening 44.

The liner 34 is of unitary molded plastic construction. The liner 34 has a peripheral flange 50 in registry with the shell flange 42, as discussed below. The liner 34 also includes a central wall portion 52 connected to the flange 50 via a pair of vertical, frontwardly projecting sidewalls 54 and 56 and opposite horizontal, frontwardly projecting top and bottom walls 58 and 60, respectively. As used herein, the term "frontwardly" relates to the disposition from the shell outer panel 36 extending toward the liner 34, and "rearwardly" vice-versa. As is particularly illustrated in FIG. 4, the sidewalls 54 and 56 are generally U-shaped in cross-section and open outwardly into the shell space 48. The sidewalls 54 and 56 are commonly known as dikes, used for supporting shelf systems.

In the illustrated embodiment, the central wall portion 52 is provided with a plurality of horizontally extending shelves defined by bottom walls 62 extending between the vertical dikes 54 and 56. Also included is an ice dispenser chute housing portion 64 for delivering ice bodies from an automatic ice making and dispensing apparatus (not shown) to an ice dispenser 66 mounted on the freezer door 28, see FIG. 1. The particular configuration of the central wall portion 52 depends upon the desired shelf configuration for any particular refrigeration apparatus 20.

In accordance with the invention, the space 48 is filled with a body 66 of rigid insulation. The body of insulation 66 adheres to both the liner 34 and the door shell 32 for securing the liner 34 to the door shell 32. Alternatively, or additionally, fasteners such as screws may be used to fasten the liner flange 50 to the shell flange 42. In accordance with the invention, the insulation body 66 comprises an in situ foam insulation which expands and cures with the door shell 32 and liner 34 preassembled and with a gasket 68 received on the liner flange 50 for sealing against the refrigerator cabinet 22 when the door 28 is closed. The insulation body 66 substantially fills the space 48 between the liner 34 and shell 32 to provide improved insulation in the freezer door 28.

With reference to FIG. 5, each shelf 62 includes a front edge 100 extending frontwardly of a corresponding front edge 102 and 104 of the respective dikes 54 and 56. A first projection 106 extends sidewardly from the dike 54 toward the dike 56. A similar projection 108 extends sidewardly from the dike 56 toward the dike 54, see FIG. 3. The projections 106 and 108 are spaced a select distance above the shelf 62. Each first projection 106 and 108 includes a ramped distal surface 110 to facilitate mounting of a trim piece 114, as discussed below.

A second projection 112 extends frontwardly from the dike 54. The second projection 112 is spaced a select distance above the shelf 62, similar to the vertical spacing of the first projection 106. A second projection 116, similar to the second projection 112, extends frontwardly from the dike 56.

With reference to FIG. 6, the shelf trim piece 114 is mountable on the inner door panel 34. The trim piece 114 comprises a front wall 118 connected to opposite end caps 120 and 122. Particularly, the trim piece 114 is integrally formed of ABS plastic.

The end cap 120 includes a base 124 defining a rearwardly opening channel 126, see FIG. 7. An end wall 128 is connected to and extends rearwardly from the base 124. The end wall 128 includes an opening 130 therethrough of a size and shape corresponding to the size and shape of the first projection distal surface 110. The end wall 128 is provided with a ramp portion 132 extending from the opening 130 to a distal edge 134.

The opposite end cap 122 includes a similar base portion 136 defining a rearwardly opening channel 138. An end wall 140 is connected to the base 136 and includes an opening 142 and ramp portion 144 similar to those discussed above.

The end walls 128 and 140 are spaced apart a select distance slightly less than the distance between the dikes 54 and 56, to be received therebetween.

The front wall 118 extends between the end caps 120 and 122. The front wall 118 includes a rearwardly opening channel 148 complementary to the shelf front edge 100 proximate a lower edge 146, see FIG. 5.

To mount the trim piece 114 on the inner door panel 34, the trim piece 114 is positioned frontwardly of the inner door panel 34 just above the shelf 62. The end walls 128 and 140 are inserted between the dikes 54 and 56, respectively, with the respective ramp portions 132 and 144 engaging the first projections 106 and 108. As the trim piece 114 is moved rearwardly, i.e., toward the central wall portion 52, at least one of the dikes 54 and 56 and end walls 128 and 140 are temporarily deformed until the first projections 106 and 108 are received in the apertures 130 and 142, respectively, to provide a snap-fit connection, see FIG. 7. Also, the second projections 112 and 116 extend into and are received in the respective channels 126 and 138. Similarly, the front wall channel 148 receives the shelf front edge 100, see FIG. 7.

The above-described construction provides a stable mounting of the trim piece 114 to the inner door panel 34. Particularly, the second projections 112 and 116 extending into the channels 126 and 138 resist side forces impacting on the end caps 120 and 122, respectively. Any such side impact will result in the trim piece 114 falling off prior to breakage. Additionally, the end wall ramp portions 134 and 144 also provide a finger grip which can aid in removal of the trim piece 114. Also, a plurality of ridges 150 in the channels 138 and 126 further help resist impact and lock around the projection 112 to prevent rocking.

The shelf trim piece 114, in connection with the shelf 62, provides a closed shelf arrangement with the formed shelf which extending the full distance of the shelf depth. The front wall 118 is designed without a bottom wall enabling it to fit with the formed shelf 62. Additionally, the trim piece 114 is secured to the inner door panel 34 without providing holes or otherwise piercing of the inner door panel 34.

In certain refrigerator models it is desirable to use a more open shelf design in which an open space is provided between the shelf and the front wall. In accordance with the invention, a trim piece 160 according to an alternative design is shown in FIG. 3. The trim piece 160 includes a front piece 162 extending between opposite end caps 164 and 165. A space 163 is provided between the front wall 162 and the bottom wall 60 which defines a shelf.

With reference also to FIGS. 8–11, the end cap 164 is integrally molded of ABS plastic and includes a base 166 defining a rearwardly opening channel 168, see FIG. 11. The channel 168 includes a plurality of ridges 169. An end wall 170 extends rearwardly from the base 166 and is provided with an opening 172. A ramp portion 174 extends between the opening 172 and a distal edge 176. A generally U-shaped blade 178 extends sidewardly immediately rearwardly of a front wall portion 180. A pair of locking tabs 182 extend rearwardly from the blade 178.

Although not specifically illustrated, the second end cap 165 is identical to the first end cap 164.

The front piece 162 may be of metal, plastic, or any other suitable material formed in a generally rectangular configuration in cross-section, as shown in FIG. 8 to provide a front wall 183 and a rear wall 186 defining a channel 184. The blade 178 for each end cap 164 and 165 is inserted in the channel 184. The locking tabs 182 engage suitable notches (not shown) in the rear wall 186 to secure the front piece 162 to each end cap 164 and 165. The front piece is selected to have a length so that the end walls 170 of the two end caps 164 and 165 are spaced a select distance apart slightly less than the spacing between the dikes 54 and 56, similar to that discussed above with the trim piece 114. Particularly, the configuration of the end caps 164 and 165 is generally similar to that of the end caps 120 and 122 of the trim piece 114. Thus, the trim piece assembly 160 is mounted to the liner inner panel 34 in a similar manner, with the second projections 112 and 116 received in the channel 168 of each end cap 164 and 165, see FIG. 11. Each first projection 106 and 108 extends through the opening 172 of each end cap 164 and 165. This provides a stable, snap-fit connection, as above.

In accordance with the invention, the inner door panel 34 is provided with a plurality of vertically spaced shelves. Each shelf 62 extends frontwardly from the dikes 54 and 56. Each shelf 62 includes the first and second projections, as discussed above, spaced vertically thereabove. Therefore, within any refrigerator line including such a common inner door panel 34, either of the trim pieces 114 or 160 can be selected for use throughout, or in any combination, to provide a closed shelf arrangement or open shelf arrangement. This eliminates the need to provide custom inner door panel structures depending on the desired shelf trim. This feature provides economies in manufacturing.

The described door shelf support system is illustrated in connection with a freezer door 28 of a side-by-side refrigerator/freezer 20. Similar systems could also be used in the fresh food door 30 or in similar doors for a top or bottom mount refrigeration apparatus or stand-alone refrigerator or freezer.

We claim:

1. In a refrigeration apparatus cabinet defining a storage space and having a door providing selective access to said space, a door shelf support system comprising:

an inner door panel including parallel, vertical dikes, each said dike including a plurality of vertically spaced sidewardly extending projections; and a shelf trim piece mountable on said inner door panel comprising a front wall connected to opposite end walls, said end walls being spaced apart a select distance slightly less than a distance between said dikes to be received therebetween, each said end wall including an aperture, at least one of said dikes and said end walls being temporarily deformed when said trim piece end walls are inserted between said dikes with opposite ones of said projections engaging said end walls until said projections are received in said apertures to provide a snap-fit connection to retain said trim piece on said door panel.

2. The door shelf support system of claim 1 wherein said inner door panel comprises a unitary molded plastic panel.

3. The door shelf support system of claim 1 wherein said shelf trim piece comprises a unitary molded plastic trim piece.

4. The door shelf support system of claim 1 wherein said shelf trim piece comprises a pair of end caps, each defining one of said end walls, and an elongate front piece captured by and extending between the end caps.

5. In a refrigeration apparatus cabinet defining a storage space and having a door providing selective access to said space, a door shelf support system comprising:

an inner door panel including parallel, vertical dikes, a horizontal shelf extending between said dikes, and a projection extending sidewardly from each dike and spaced a select distance above said shelf; and a shelf trim piece mountable on said inner door panel comprising a front wall connected to opposite end walls, said end walls being spaced apart a select distance slightly less than a distance between said dikes to be received therebetween, each said end wall including an aperture, at least one of said dikes and said end walls being temporarily deformed when said trim piece end walls are inserted between said dikes with opposite ones of said projections engaging said end walls until said projections are received in said apertures to provide a snap-fit connection to retain said trim piece on said door panel above said shelf.

6. The door shelf support system of claim 5 wherein said inner door panel comprises a unitary molded plastic panel.

7. The door shelf support system of claim 5 wherein said shelf trim piece comprises a unitary molded plastic trim piece.

8. The door shelf support system of claim 7 wherein said shelf trim piece includes a front wall extending between said end walls and a lower edge of said front wall includes a channel receiving a front edge of said shelf to provide a generally closed shelf arrangement.

9. The door shelf support system of claim 8 wherein said shelf front edge is disposed frontwardly of a front edge of said dikes.

10. The door shelf support system of claim 5 wherein said shelf trim piece comprises a pair of end caps, each defining one of said end walls, and an elongate front piece captured by and extending between the end caps.

11. In a refrigeration apparatus cabinet defining a storage space and having a door providing selective access to said space, a door shelf support system comprising:

an inner door panel including parallel, vertical dikes, a horizontal shelf extending between said dikes, a first projection extending sidewardly from each dike and spaced a first select distance above said shelf and a second projection extending frontwardly from each dike and spaced a second select distance above said shelf; and a shelf trim piece mountable on said inner door panel comprising a front wall connected to opposite end caps, each end cap including a base defining a rearwardly opening channel and connected to a rearwardly extending end wall, said end walls being spaced apart a select distance slightly less than a distance between said dikes to be received therebetween, each said end wall including an aperture, at least one of said dikes and said end walls being temporarily deformed when said trim piece end walls are inserted between said dikes with opposite ones of said projections engaging said end walls until said first projections are received in said apertures and said second projections are received in said channels to provide a stable, snap-fit connection to retain said trim piece on said door panel above said shelf.

12. The door shelf support system of claim 11 wherein said inner door panel comprises a unitary molded plastic panel.

13. The door shelf support system of claim 11 wherein said shelf trim piece comprises a unitary molded plastic trim piece.

14. The door shelf support system of claim 13 wherein said shelf trim piece includes a front wall extending between said end walls and a lower edge of said front wall includes a channel receiving a front edge of said shelf to provide a generally closed shelf arrangement.

15. The door shelf support system of claim 14 wherein said shelf front edge is disposed frontwardly of a front edge of said dikes.

16. The door shelf support system of claim 11 wherein said shelf trim piece comprises a pair of end caps, each defining one of said end walls, and an elongate front piece captured by and extending between the end caps.

17. The door shelf support system of claim 11 wherein each said end wall includes a raised ramp portion extending from said opening to a distal edge to facilitate insertion of said end walls between said dikes.

18. The door shelf support system of claim 11 wherein said first projections include a ramped distal surface to facilitate insertion of said end walls between said dikes.

19. The door shelf support system of claim 11 wherein said first select distance is equal to said second select distance.

* * * * *